United States Patent [19]

Peterson

[11] Patent Number: 4,928,768

[45] Date of Patent: May 29, 1990

[54] SUMP PACKER LATCHING MECHANISM

[75] Inventor: Elmer R. Peterson, The Woodlands, Tex.

[73] Assignee: Baker Hughes Incorporated, Houston, Tex.

[21] Appl. No.: 308,878

[22] Filed: Feb. 9, 1989

[51] Int. Cl.[5] ..... E21B 22/02

[52] U.S. Cl. ..... 166/380; 166/387; 166/125

[58] Field of Search ..... 166/380, 386, 387, 125, 166/182, 242

[56] References Cited

U.S. PATENT DOCUMENTS 4,657,078 4/1987 Fiaser, III et al. ..... 166/125 X 4,745,974 5/1988 Higgins ..... 166/125 X

*Primary Examiner*—William P. Neuder

*Attorney, Agent, or Firm*—Hubbard, Thurman, Turner & Tucker

[57] ABSTRACT

A locking mechanism for anchoring a tubing string to a hollow bore sump packer located at a position in a subterranean well. The locking mechanism is attachable to the end of a tubing string and incorporates radially shiftable locking members which are engagable with an internal, downwardly facing shoulder defined within the hollow bore of the sum packer. The radially shiftable locking elements are moved from a retracted to a locking position by reciprocating movements of a mandrel carried by the tubing string. A supporting surface on the mandrel controls the position of the radially shiftable locking elements. The position of the supporting surface relative to the radially shiftable locking elements is controlled by a J-pin secured to the sleeve carrying the radially shiftable locking elements and a cooperating J-slot carried by the mandrel. The configuration of the J-slot requires that the mandrel be shifted downwardly and then upwardly to engage the locking elements with the packer shoulder and again shifted downwardly and then upwardly to effect the unlocking of the locking elements relative to the locking shoulder. In a modification, the left hand threads conventionally provided on the top of the packer is utilized as the locking shoulder, and the locking members are carried on a sleeve surrounding the mandrel.

22 Claims, 4 Drawing Sheets

SUMP PACKER LATCHING MECHANISM

BACKGROUND OF THE INVENTION

1. Field of the Invention:

This invention relates to a locking mechanism secured to the bottom end of a tubing string which is to be secured in a hollow bore sump packer located at a position in a subterranean well, such as a substantially horizontal portion of the well which traverses a production formation.

2. Summary of the Prior Art:

In recent years, considerable interest has been expressed in utilizing the economies associated with drilling a subterranean well along a path which traverses the length of the formation, rather than the height or depth of the formation. Such drilling necessarily requires that the initial or entry portion of the subterranean well be substantially vertical and then be curved to produce a deviated portion which traverses the production formation and may lie in a substantially horizontal plane.

The insertion of a tool string through the curved portion of such deviated well requires the application of a substantial downward force accompanied by a rotation of the tubing string and necessarily generates very high frictional resistance to both movements. As a result, when the end of the tubing string reaches a conventional hollow bore sump packer and is inserted therein, an upward pull on the order of 100,000 lbs. must be exerted on the tubing string to insure that the tubing string is anchored to the sump packer.

Conventional locking mechanisms for sump packers normally involves latching elements which are releasable from the sump packer by the exertion of upward forces thereon on the order of 10 or 15 thousand lbs. The frictional forces acting on the tubing string by virtue of passage through the curved portion of the well bore are typically of a magnitude to make detection at the surface of the well of such a small force change extremely difficult if not impossible.

There is, therefore, a definitive need for a latching mechanism for effecting the locking of a tubing string to a sump packer located in a well bore which will withstand, when locked, an upward tensile force on the order of 100,000 lbs., yet may be released from the sump packer through further manipulation of the tubing string.

An additional problem arises in the utilization of conventional latching mechanisms in that the position of the locking elements is generally controlled by a J-slot and pin connection between an outer sleeve element of the latching mechanism and an inner mandrel which is secured to the tubing string. Because rotation of the tubing string is required to effect the insertion of the tubing string through the curved portion of a deviated well bore, conventional shear screws cannot be employed to effect the securement of the J-sleeve and locking pin in a desired position during insertion in the well. There is, therefore, a further problem that has to be solved in providing a J-pin and slot mechanism for effecting the movement of the locking elements to and from a locking position which will not be secured by shear screws or the like during insertion of the locking mechanism through the curved portion of the deviated well so that the exact position of the latching elements relative to the sump packer when such elements reach the sump packer is unknown, yet the reliable functioning of the latching elements solely by manipulation of the tubing string is an essential requirement.

The principal object of this invention is to provide a locking mechanism for a sump packer located in the deviated portion of a subterranean well which will overcome the above mentioned deficiencies of prior art locking mechanisms.

SUMMARY OF THE INVENTION

The locking mechanism embodying this invention comprises a mandrel which is secured to the bottom end of a tubing string or liner. A sleeve is provided in surrounding, freely rotatable relationship to the mandrel and is relatively movable with respect to the mandrel through a limited axial distance.

The sleeve carries a plurality of peripherally spaced, radially shiftable locking elements such as the locking heads of a collet which are cooperable with a downwardly facing internal shoulder provided in or adjacent the hollow bore of the sump packer. A supporting surface is provided on the mandrel which, when the mandrel is elevated relative to the sleeve carrying the locking element, will prevent the radially inward displacement of the locking elements to a position permitting passage of such elements past the downwardly facing locking surface. Thus, a locking engagement is achieved which is capable of sustaining an upward tensile force on the order of about 100 thousand lbs.

An inwardly projecting J-pin is provided on the sleeve which cooperates with a J-slot provided in a J sleeve which is rotatably mounted on the mandrel. The configuration of the J-slot is such that subsequent downward movement of the mandrel will effect the removal of the supporting surface on the mandrel from engagement with the locking elements and permit the locking elements to shift inwardly into a reduced diameter portion of the mandrel. The J-slot retains the sleeve in this position during subsequent upward movement of the mandrel relative to the sleeve, thus permitting the entire mandrel and locking mechanism to be moved upwardly out of the hollow bore sump packer. Subsequent downward movement of the mandrel will allow the locking elements to shift to their radially inward positions so that they may pass through and below the downwardly facing internal locking shoulder of the sump packer, but will concurrently shift the J-slot so that the J-pin now lies in a position wherein subsequent upward movement of the mandrel will effect the support of the locking elements to engage the downwardly facing locking shoulder in the hollow bore sump packer.

Further objects and advantages of the invention will be readily apparent to those skilled in the art from the following detailed description, taken in conjunction with annexed sheets of drawings, on which is shown a preferred embodiment of the invention.

BRIEF DESCRIPTION OF THE DRAWINGS

In FIG. 4 the components of the locking mechanism are shown in their unlocked position.

DESCRIPTION OF PREFERRED EMBODIMENT

Figure 1A:
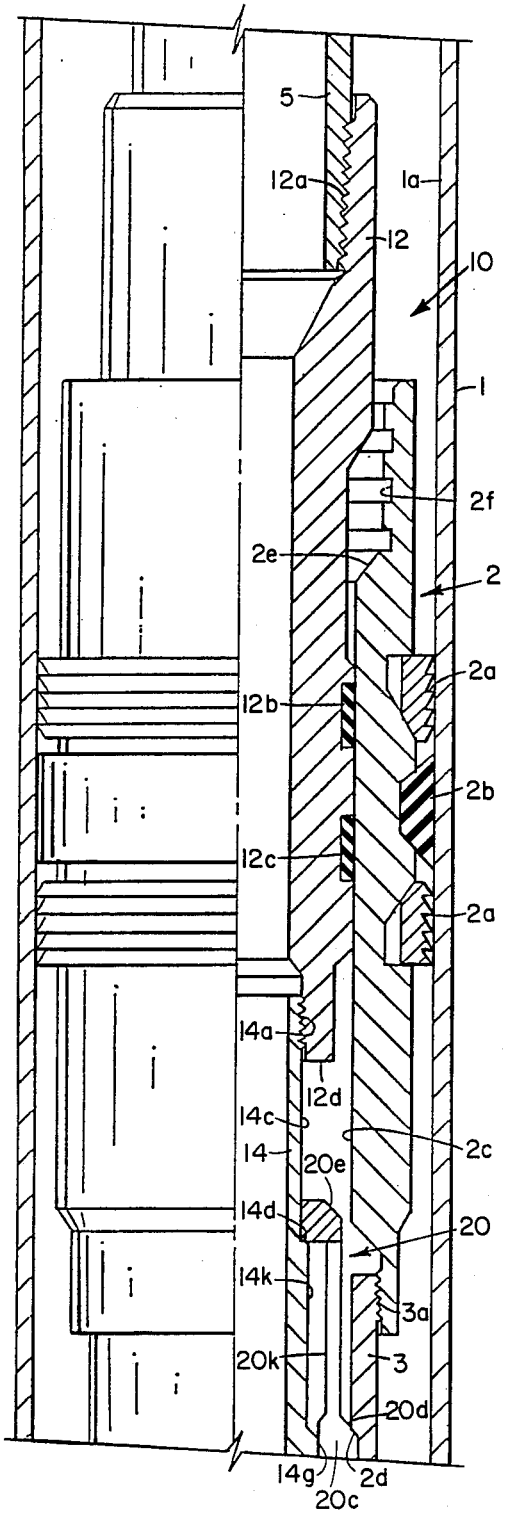
FIGS. 1A and 1B collectively represent a vertical, sectional view illustrating a locking mechanism embodying this invention engaged with a sump packer located in a deviated portion of a subterranean well casing.
Figure 1B:
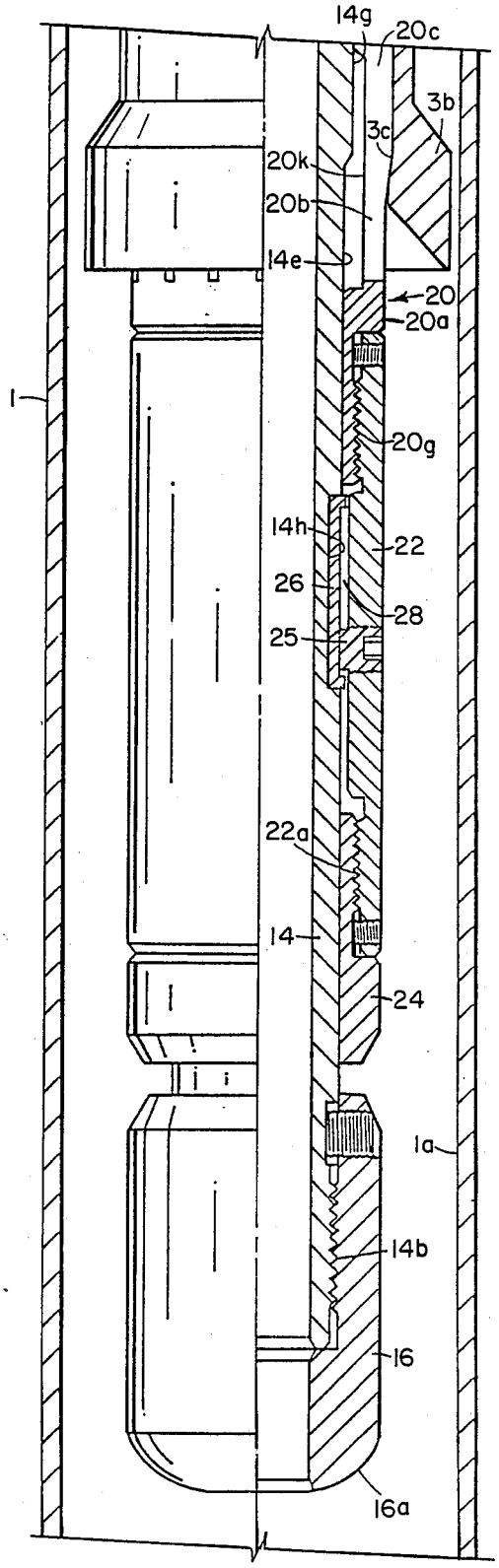

Referring to FIGS. 1A and 1B, the numeral 1 indicates a deviated portion of a casing inserted in a deviated subterranean well bore. Such deviated well bore has a generally vertical entry portion (not shown) which communicates through a curved portion with a substantially horizontal deviated portion within which the casing 1 is located. The deviated casing portion 1 is not shown in a generally horizontal position, but it should be understood that it could lie at a significant angle relative to the horizontal since the purpose of the deviated well bore is to follow the horizontal contour of a production formation and traverse the production formation in a generally horizontal direction. Obviously, to insert the casing 1 in such a deviated well bore, it is necessary to apply very large compressive forces, accompanied by rotation of the casing, in order to force the casing through the curved portion of the well bore.

A sump packer 2 is conventionally mounted adjacent the end of the deviated casing portion 1. Sump packer 2 includes conventional slips 2*a* which bitingly engage the interior wall 1*a* of the deviated casing portion 1, and at least one expanded elastomeric sealing element 2*b* which effects a seal with the inner wall 1*a* of the deviated casing portion 1. Such sump packer is entirely conventional and may be set either by mechanical manipulation of a tubing string by which it is forced into position within the deviated casing portion 1 or preferably, by a conventional hydraulic setting mechanism (not shown). In either event, the sump packer 2 defines a hollow bore 2*c* extending entirely through the packer body. A downwardly facing, internally projecting shoulder 2*d* is provided in the hollow bore portion 2*c* of the sump packer 2. Such downwardly facing shoulder 2*d* may be formed as an integral part of the body of the sump packer 2 or it may be formed on an anchor sleeve 3 which is threadably secured by threads 3*a* to the lower portion of the sump packer 2. If no seal is required, the sump packer could be eliminated and the shoulder 2*d* provided on the casing 1 The sump packer 2 is constructed so that it is able to withstand an upward force on the order of 100 thousand pounds applied to the downwardly facing shoulder 2*d* when the sump packer 2 is set within the deviated casing portion 1. The sump packer 2 is provided at its upper end with an upwardly facing, outwardly directed setdown shoulder 2*e* and, above such shoulder, with a set of left hand threads 2*f* by which the tubing string utilized to insert the sump packer 2 in the casing portion 1 may be disconnected from the sump packer and removed from the well.

Lastly, the bottom end portion of the sump packer 2 or, in the illustrated example, the bottom end of the anchor sleeve 3 is provided with an enlarged annular projection 3*b* having an internally projecting, inclined surface 3*c* for a purpose to be hereinafter described.

Referring still to FIGS. 1A and 1B, there is shown a tubular locking mechanism 10 which is connectable to the bottom end of a tubing string 5 for insertion into the deviated casing portion 1 and locked to the sump packer 2 in the manner illustrated in FIGS. 1A and 1B. The tubular locking mechanism 10 comprises a tubular main body portion 12 having internal threads 12*a* at its upper end for connection to the bottom end of the tubing string 5. Axially spaced, external sealing elements 12*b* and 12*c* are mounted on the body portion 12 to sealingly engage the hollow bore 2*c* of the sump packer 2 when the tubular locking mechanism 10 is inserted therein.

A sleeve-like body extension or mandrel 14 is secured to the lower end of the main body portion 12 by threads 14*a*. The extension sleeve 14 is provided at its lower end with external threads 14*b* to which is secured a centralizing plug 16 having a rounded bottom end 16*a* to facilitate passage of the locking mechanism 10 through the curved portion (not shown) of the casing. Of course, a tool string including items such as a safety joint and a screen or perforated nipple may be attached below the packer as a tubular continuation of the tubing string. A special safety joint capable of transmitting high tensile forces must however be utilized, as hereinafter described.

The body extension sleeve 14 essentially constitutes a mandrel around which is mounted a collet assemblage 20. Collet assemblage 20 comprises a major ring portion 20*a* at one end having a plurality of peripherally spaced, flexible arm portions 20*b* which in turn have radially enlarged, medial locking portions 20*c* defining upwardly facing, external surfaces 20*d* for engagement with the downwardly facing surface 2*d* formed in the bore of the hollow packer 2. The other ends of the collet arm portions 20*b* terminate in an inwardly projecting, minor ring portion 20*e* which slidably engages a reduced diameter external bearing portion 14*c* defined on the upper end of mandrel 14. The collet assemblage 20 is thus axially movable relative to the extension body sleeve or mandrel 14 through an axial distance corresponding to the spacing between an upwardly facing shoulder 14*d* on the mandrel 14 and the bottom end 12*d* of the main body portion 12 of the locking mechanism 10.

Figure 2:
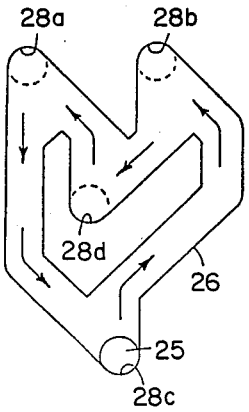
FIG. 2 is an enlarged scale projected elevational view of the J-slot provided in the locking mechanism of FIGS. 1A and 1B.

The major ring portion 20*a* of the collet 20 is provided with external threads 20*g* which secure a J-pin mounting sleeve 22. J-pin mounting sleeve 22 is disposed in radially spaced relationship to the mandrel 14 and is secured in such relationship at its bottom end by internal threads 22*a* which cooperate with corresponding threads provided on a guide sleeve 24 which is slidably mounted on the mandrel external surface 14*e*. It will therefore be apparent that the collet mechanism 20 is mounted for both rotational and axially shiftable movement relative to the mandrel 14. The extent of such relative rotational and axial movement is controlled by an internally projecting J-pin 25 which is radially mounted in the J-pin mounting sleeve 22 and engages a J-pin slot 28 formed in a C-ring 26 which is inserted into an annular recess 14h formed on the exterior of the mandrel surface 14e. The detailed configuration of the J-pin slot 28 is shown in the projected view of FIG. 2.

It should be particularly noticed that the J-pin 25 is not preliminarily secured in any particular position within the J-pin slot 28. The reason for this is that the insertion of the locking mechanism 10 through the curved portion (not shown) of the casing requires both an axial movement and a rotational movement of the tubing string 5 to effect the movement of the tubing string 5 and locking mechanism 10 through such curved casing portion. If, as is conventional, any attempt were made to secure the J-pin carrying sleeve 22 in a desired position of the J-pin 25 relative to the J-pin slot 28, the high frictional forces exerted on the exterior of the locking mechanism 10 in both a rotational and axial direction would effect the shearing of any such retention mechanism. Therefore, the J-pin carrying sleeve 22 is free to rotate and to move axially through a limited distance during the insertion of the locking mechanism 10 through the curved portion (not shown) of the casing 1.

Since the position of the J-pin 25 in J-slot 28 is unknown after the locking mechanism has traversed the curved. portion of the casing, let it first be assumed that the J-pin 25, is in the position 28c. In this position, an enlarged supporting surface 14g provided on the exterior of the mandrel 14 is in abutting engagement with the inner surfaces of the locking heads 20c of the collet 20 thus preventing such collet locking heads from deflecting radially inward from the position shown, and the locking mechanism 10 would be locked if it were fully inserted in the sump packer 2, as shown in FIGS. 1A and 1B.

Figure 3A:
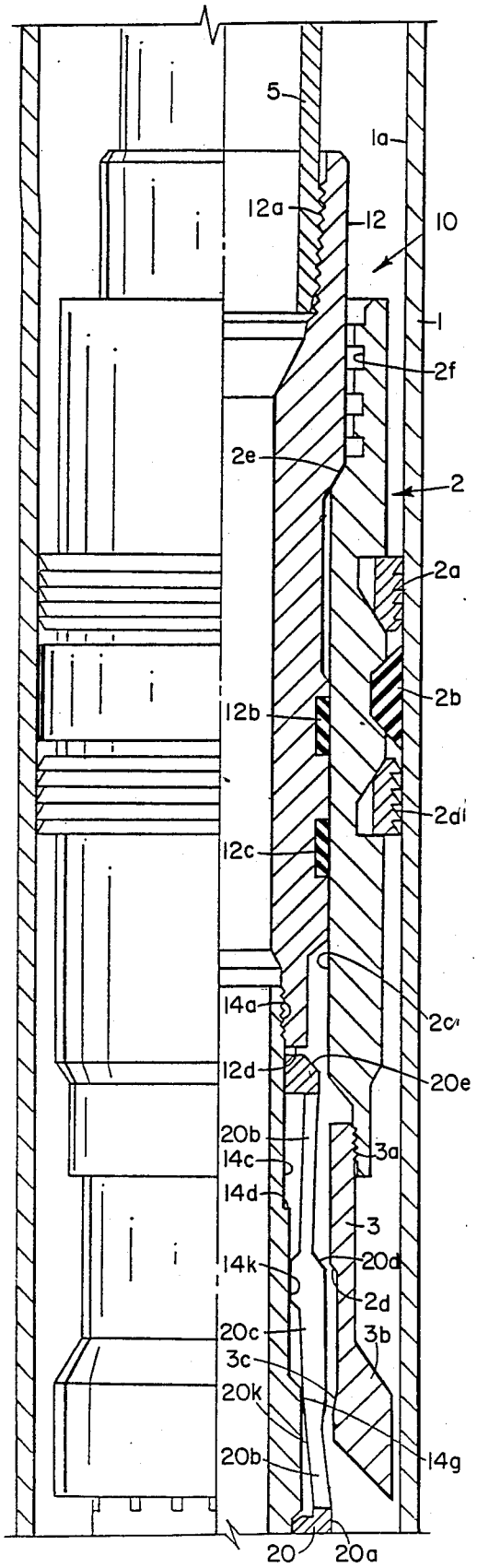
FIGS. 3A and 3B collectively constitute a view similar to FIGS. 1A and 1B but with the locking elements in a disengaged position relative to the sump packer.
Figure 3B:
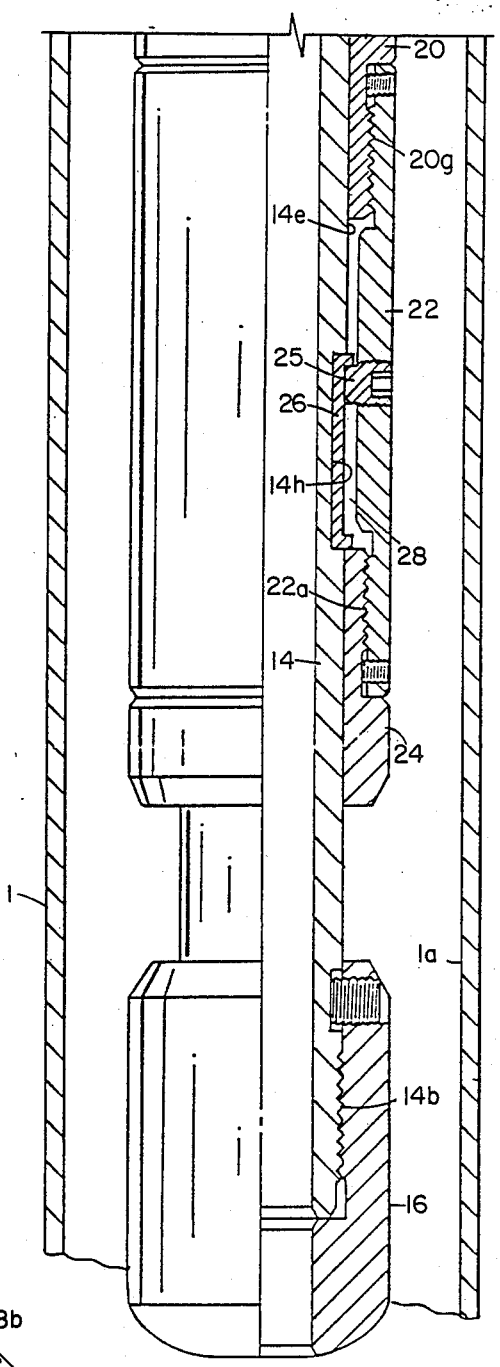

However, in such radially outward position, the collet heads 20c would engage the setdown shoulder 2e provided in the sump packer 2 and would prevent further downward movement of the collet mounting assemblage 20, thus permitting the mandrel 14 to be moved downwardly by the tubing string 5 until the downwardly facing end face 12d of the main body portion 12 of the locking mechanism 10 engages the upper ring portion 20e of the collet mechanism 20, as illustrated in FIGS. 3A and 3B. In this position, the mandrel supporting surface 14g is opposite the recessed surface 20k of the collet arms 20b. In this position, enlarged collet locking heads 20c may be deflected inwardly until stopped by mandrel surface 14k, to release from engagement with the setdown shoulder 2e and permit the locking mechanism 10 to pass downwardly through the hollow bore 2c of the sump packer 2. As a result of such movement of the mandrel, the J-pin 25 moves to position 28b of J-slot 28.

When the J-pin 25 is in either of the upper positions 28a or 28b of the J-slot 28, the locking heads 20c of the collet mechanism 20 will pass freely through the downwardly facing locking shoulder 2d formed on the sump packer 2 but will engage the internally projecting shoulder 3c on anchor sleeve 3.

Whenever the J-pin 25 is in the position 28b of J-slot 28, an upward movement of the tubing string 5 will bring the J-pin 25 to the position in the J-slot 28 indicated at 28d. In this position, the enlarged mandrel supporting surface 14g will again be opposite the recessed surface 20k of the collet arms and hence continued upward movement will cause packer shoulder 2d to deflect locking heads 20c radially inward and allow the locking mechanism to pass upwardly through the packer bore.

Downward movement of mandrel 14 moves the J-pin to position 28a. Whenever the J-pin 25 is in the position 28a of the J-pin slot 28, the elements of locking mechanism 10 are in the same positions as described for position 28b. Accordingly, a subsequent upward movement of the tubular liner 5, hence of the mandrel 14, will result in an upward movement of the J-pin slot 28 relative to the J-pin 25 to shift the J-pin 25 to the bottom slot position indicated at 28c. In this position, as previously described, the enlarged supporting surface 14g of the mandrel 14 will be disposed opposite the enlarged locking heads 20c of the collet mechanism 20 (FIGS. 1A and 1B) and hence such locking heads will be supported outwardly into engagement with the downwardly facing shoulder 2d of the sump packer 2, thus preventing any further upward movement of the tubing string or liner 5. In the locked position, the locking mechanism will be resistant to the application of a tensile force on the order of 100 thousand lbs. The potential application of such a large force is required due to the frictional restraints imposed on the tubing string 5 by its passage through the curved portion (not shown) of the casing 1. The resistance of the tubing string to further movement under the influence of such a large tensile force will provide the operator with assurance that the locking mechanism 10 is engaged with the sump packer 2.

As previously described, whenever it is desired to release the locking mechanism 10, it is only necessary to effect a downward movement of the tubing string or liner 5, hence of the mandrel 14 and this will effect the shifting of the J-pin 25 from its lowermost position 28c in J-slot 28 to the uppermost position 28b and as illustrated in FIGS. 3A and 3B.

Any other initial position of the J-pin 25 will result in the positioning of the J-pin 25 in J-slot portions 28b and 28c by lowering the tubing string, following which the setting of the locking mechanism 10 proceeds as described.

It is therefore apparent to those skilled in the art that the aforedescribed invention provides for the selective locking and unlocking of a tubing string to a sump packer located in a well bore with assurance and reliability, particularly when, for whatever reason, the locking mechanism is subjected to the application of a tensile force on the order of 100 thousand pounds. The testing of the locking mechanism can be accomplished through the application of tensile forces sufficiently large to insure that the locking mechanism is truly engaged and that the tensile forces are not merely absorbed by the frictional engagement of the tubing string with the curved portion of the casing. Furthermore, the locking mechanism may be readily released by an axial manipulation of the tubing string. Most importantly, no shear screws or similar mechanisms are required to effect the retention of the J-pin and slot in a desired initial relationship to each other but such elements are free to move rotationally and axially relative to each other during the difficult insertion of the locking mechanism through the curved portion of the casing.

After the initial insertion of the locking mechanism into the sump packer, the locking and unlocking of the locking mechanism are each accomplished by a downstroke of the mandrel followed by an upstroke. Such movements are readily accomplished by the surface movement of the tubing string or liner.

Figure 4:
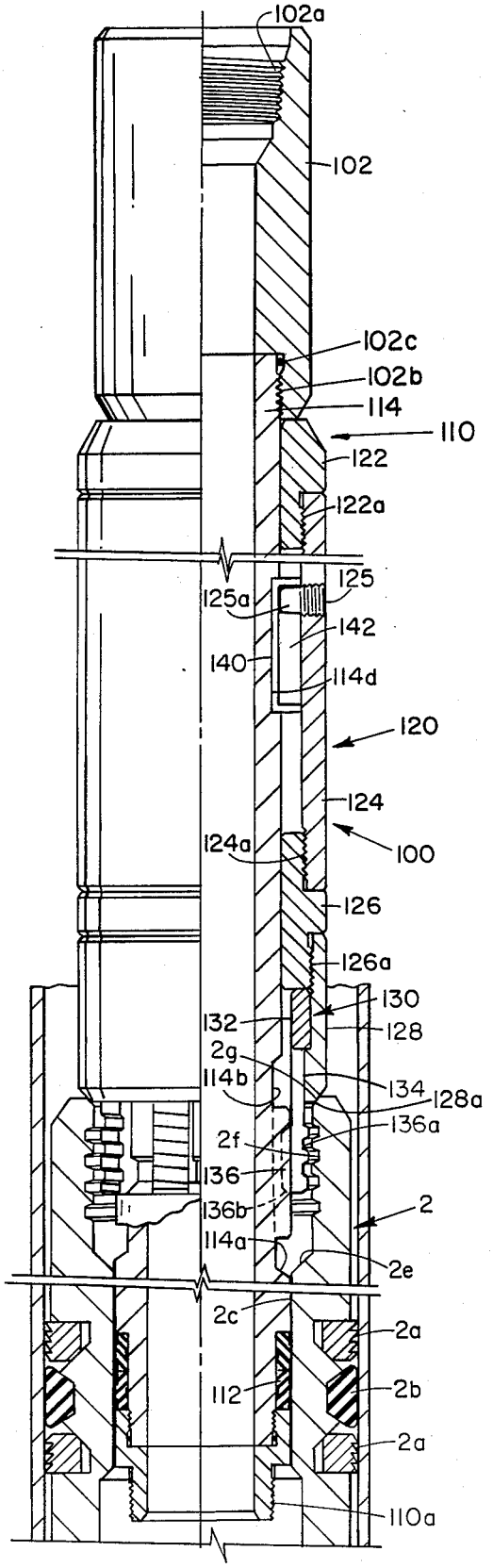
FIG. 4 is a quarter sectional view of a modified version of this invention providing a greater bore diameter through the packer after the tubing string is locked thereto.
Figure 5:
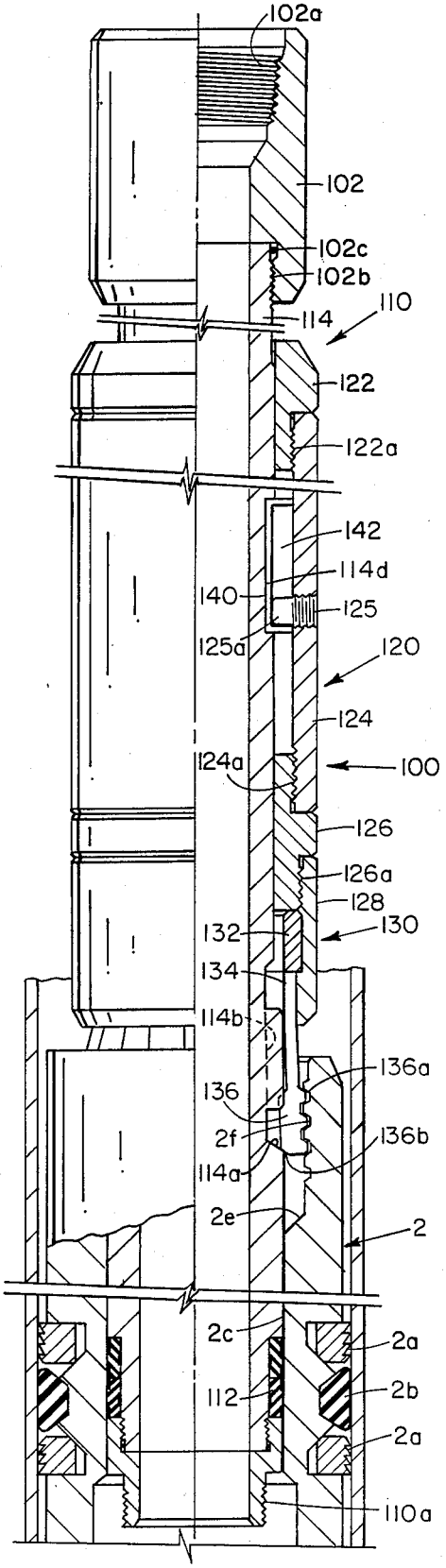
FIG. 5 is a view similar to FIG. 4 but showing the position of the components of the locking mechanism in their locked position.

Referring now to FIGS. 4, and 5, there is shown an embodiment of this invention wherein the locking is effected by a plurality of peripherally spaced collet heads having threaded segments formed thereon for engagement with the conventional left hand threads commonly found on any packer, such as the threads 2*f* of FIG. 1. The construction of the packer 2 is substantially the same as shown in FIG. 1A and similar numerals represent similar parts. The packer 2 is shown in its set position wherein the slips 2*a* and the elastomeric seal element 2*b* are in intimate engagement with the bore wall 1*a* of the casing 1. As in the case of FIG. 1A, the packer 2 defines a central seal bore 2*c*. The element 3 which provided the locking shoulder 2*d* is not, however, utilized.

A tubular locking assemblage 100 is provided comprising an upper sub 102 having internal threads 102*a* for engagement with the end of a tubing string or tool string. The lower end of upper sub 102 is provided with internal threads 102*b* and an O-ring 102*c* for threaded, sealed engagement with the upper end of a mandrel assemblage 110 which extends downwardly through the remainder of the locking assemblage. The upper end of mandrel assemblage comprises an elongated sleeve 114, while the lower end of mandrel assemblage 110 threadably mounts a plurality of axially spaced, conventional external seal elements 112 which engage the seal bore 2*c* of the packer 2 in sliding, sealable relationship. The bottom end of mandrel sleeve assembly 110 is provided with external threads 110*a* for mounting thereon additional tools conventionally employed below a packer, such as a safety joint, to be later described, and a screen for receiving formation fluids.

A tubular locking sleeve assemblage 120 is mounted on the upper portion of the mandrel sleeve 114 for limited axial movements relative thereto. In the upward direction, locking sleeve assemblage 120 abuts the bottom end of the top sub 102 and in a lower direction, the locking sleeve assemblage 120 abuts an upwardly facing, inclined shoulder 114*a* formed on the lower portion of the mandrel sleeve 114.

The locking sleeve assemblage 120 includes a top collar 122 having external threads 122*a* which is secured to J-pin mounting sleeve 124. The lower end of J-pin mounting sleeve 124 is provided with internal threads 124*a* which cooperate with the top threads of a pin type connecting sleeve 126. Connecting sleeve 126 has lower external threads 126*a* which connect with a collet retention sleeve 128.

A collet 130 is provided having a ring portion 132 retained in assembly by the collet retaining sleeve 128 and a plurality of downwardly depending, collet arms 134 having enlarged end portions 136 on which external threads 136*a* are formed and a downwardly facing inclined surface 136*b* on their bottom ends which cooperates with the upwardly facing inclined surface 114*a* provided on the mandrel sleeve 114. FIG. 4 shows the locking sleeve assemblage in its most likely run-in position where casing friction has shifted the locking sleeve assemblage 120 upwardly relative to the mandrel assemblage 110 and it will be noted that the enlarged head portions 136 of the collet 130 are disposed within an annular recess 114*b* provided on the periphery of the mandrel sleeve 114, and hence collet teeth 136*a* are free to deflect inward from the internal left hand threads 2*f* of the packer.

Figure 6:
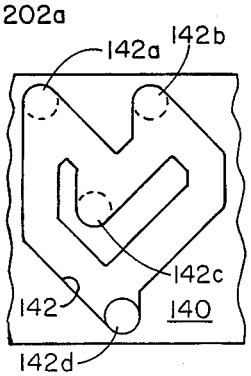
FIG. 6 is a developed view showing the contour of the J-slot utilized in the embodiment of FIG. 4 through which the J-pin travels.

The movement of the locking sleeve assemblage 120 relative to the mandrel assemblage 110 is controlled by a J-pin 125 which is rigidly mounted in radially inwardly projecting relationship in the J-pin mounting sleeve 124. The inwardly projecting end 125*a* of J-pin 125 cooperates with a J-slot 142 defined in a C-ring 140 which is inserted in an annular recess 114*d* provided on the upper portion of the surface of the mandrel sleeve 114. The exact configuration of the J-pin slot 142 is shown in FIG. 6 and corresponds exactly to the configuration shown in FIG. 2 of the previously described modification.

As in the previously described modification, the position of the J-pin 125 with respect to the J-slot 142 when the mandrel assemblage 110 is inserted in the top end of the packer 2 will not be precisely known. However, the most likely position of the J-pin 125 is in either position 142*a* or 142*b* of the J-slot 142. In either position, the locking assemblage 100 will move downwardly into the packer 2 until the end 128*a* of collet retainer 128 bottoms on the end surface 2*g* of the packer 2. In this position, the collet heads 136 pass through the packer threads 4*f*. If J-pin 125 is in slot position 142*b*, then subsequent limited upward movement of the mandrel assemblage 110 will effect the shifting of the J-pin 125 to the intermediate position 142*c*, and the collet heads 136 deflect inwardly and pass freely through the packer threads 4*f* as the J-pin mounting sleeve 124 is moved upwardly by J-pin 125.

A subsequent downward movement of the mandrel assemblage 110 will effect the shifting of the J-pin 125 to slot position 142*a* , where the collet threads 136*a* are engaged with packer threads 4*f*. An upward movement of the mandrel assemblage 110 will then bring the inclined surface 114*a* on the mandrel assemblage 110 into engagement with the downwardly facing, inclined surface 136*b* formed on the collet heads 136 and prevent the collet heads from deflecting inwardly from the left hand square threads 2*f* of the packer 2 and thus rigidly lock the mandrel assemblage 110 and the tubing string to the packer, in the same manner as previously described in connection with the other embodiment of this invention, J-pin 125 moves to position 142*d*.

Thus, to actuate the locking mechanism, it is only necessary to make a downward stroke of the tubing string followed by an upward stroke. To release the locking mechanism, a second downward stroke of the tubing string followed by an upward stroke will effect the disengagement of the collet locking heads 136 with the packer square threads 2*f* and permit the tubing string to be removed from the packer.

The advantages of the modification of FIGS. 4 and 5 lies in the fact that the internal bore of the mandrel can be significantly larger because the collet locking mechanism engages downwardly facing abutments represented by the internal square threads 2*f*, which are of significantly larger diameter than the internal downwardly facing shoulder 2*d* formed on the packer body in the previously described modification.

As mentioned above, it is desirable when utilizing either modification of this invention to incorporate a safety joint between the packer and the screen, which is normally disposed below the packer and is apt to be subsequently trapped in position due to either collection of debris or the intentional placement of gravel around the screen. Since it is contemplated that tensile forces on the order of 100 thousand pounds are to be applied to the tubing string to test the validity of the connection between the tubing string and the packer, the safety joint must have a construction capable of transmitting such tensile forces. Conventional shear-out safety joints normally release by shearing of shear screws upon the application of tensile forces on the order of 30 to 50,000 pounds. Accordingly, a modified safety joint has been provided as shown in FIGS. 7 and 8.

Figure 7:
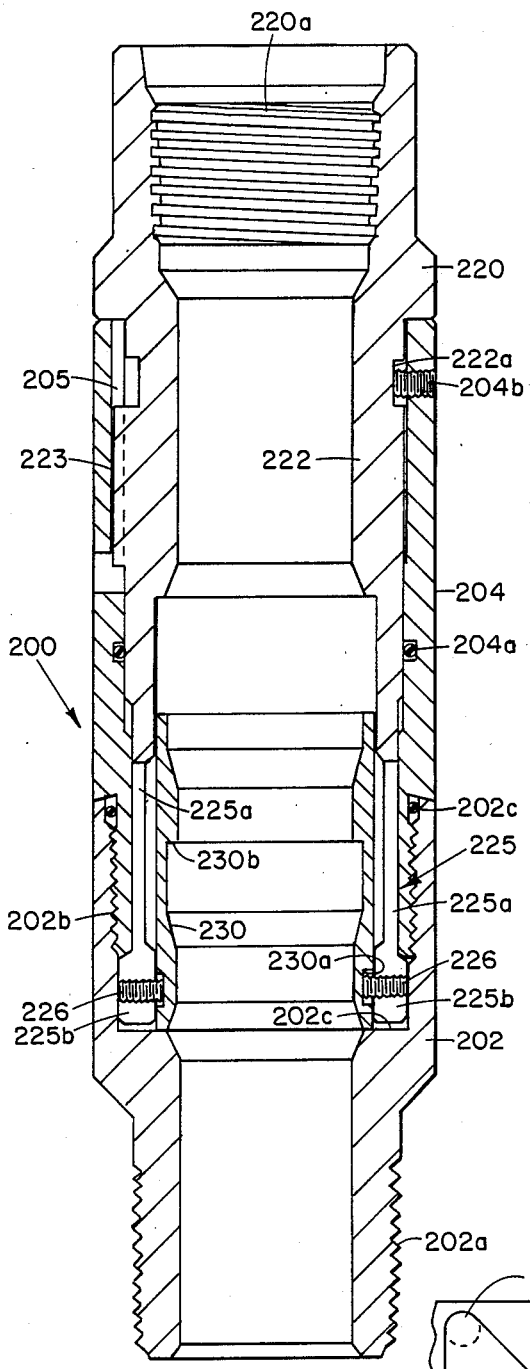
FIG. 7 is a vertical sectional view of a safety joint specifically constructed for use with tool strings embodying this invention, with the elements thereof shown in their locked positions.
Figure 8:
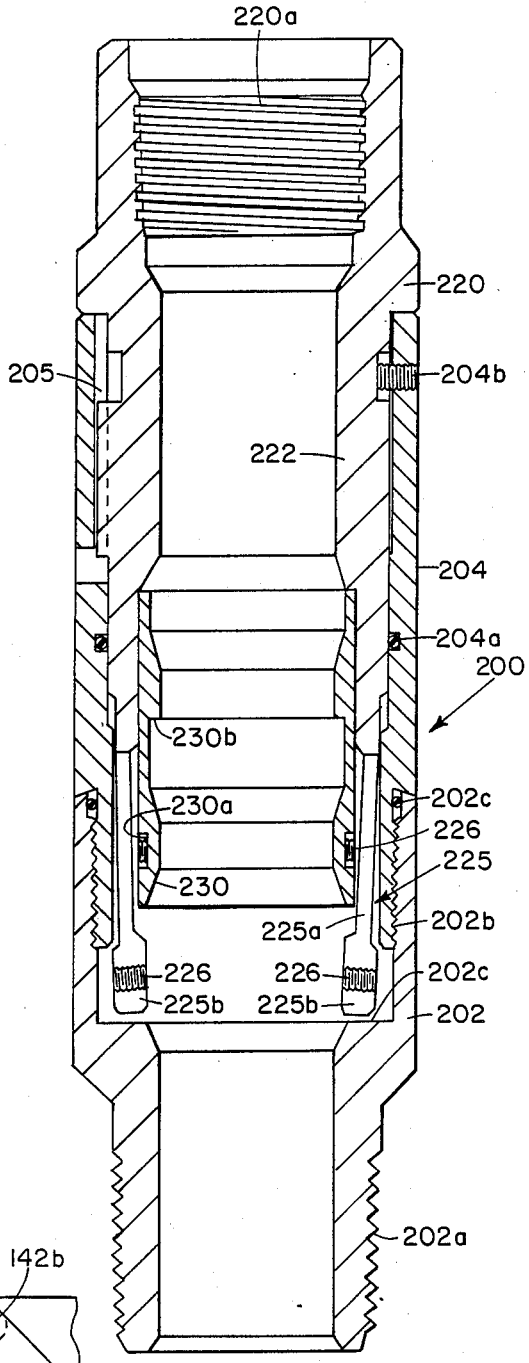
FIG. 8 is a view similar to FIG. 7 but showing the elements of the safety joint in their unlocked positions.

Referring to FIGS. 7 and 8, the safety joint 200 incorporates the feature of being able to transmit tensile forces on the order of 100,000 pounds without coming apart, yet may be readily separated through the application of an actuating tool to the device. Such device comprises a lower sub 202 having external threads 202*a* at its lower end for incorporation in the string of tools disposed below the packer. Lower sub 202 is threadably connected at its upper end by threads 202*b* and sealed by O-ring 202*c* to an extension sleeve 204.

An upper sub 220 has internal threads 220*a* for connection in series relationship to the aforementioned tool string and has a sleeve like body portion 222 which is disposed in telescopic engagement with the extension sleeve 204 of the lower sub 202. An O-ring 204*a* seals this telescoping connection. A plurality of peripherally spaced shear screws 204*b* mounted in the upper end of lower sub extension 204 engage an annular slot 222*a* formed in the upper sub 220 to secure the two subs together. Axially extending splines 223 and 205 prevent relative rotation of the two subs.

Tensile force between the two subs is, however, transmitted by a collet 225 integrally formed on the bottom end of the upper sub 220. Collet 225 has a plurality of peripherally spaced resilient arms 225*a* which terminate in enlarged head portions 225*b*. Each of the head portions 225*b* is contoured to fit into the annular recess defined between the bottom end of the extension sleeve 204 and the upwardly facing surface 202*c* defined by the lower sub 202.

The collet arms 225*a* are spring biased to a radially inward position shown in FIG. 8 but are secured in locking relationship by a retention sleeve 230 which is mounted within the lower end of the top sub 220 for limited axial movement. In the run-in position shown in FIG. 7, the locking sleeve 230 is retained in abutment with the collet locking heads 225*b* by shear screws 226 which traversE each of the collet heads and engage an annular groove 230*a* provided on the periphery of the retention sleeve 230. Thus, it will be readily apparent that the tensile forces are transmitted from the upper sub 220 through the collet heads 225*b* directly to the lower sub 202 and no shear screws are involved in this force transmission path.

When it is desired to release the safety joint, an actuating tool is lowered into the well and engaged with a downwardly facing internal surface 230*b* formed on the retention sleeve 230. A modest upward pull applied to the retention sleeve 230 will effect the shearing of shear screws 226 and hence free the collet locking heads 225*b* from engagement with the bottom sub, permitting the shear screws 204*b* to be severed and the top sub 220 to be separated from the tool string located below the safety joint 200 and retrieved from the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for effecting successive locking and unlocking of a tubing string to a hollow bore packer secured downhole in a subterranean well bore wherein the locking of the tubing string to the hollow bore packer can withstand a tensile force on the order of about 100,000 pounds, comprising, in combination:

means on said hollow bore packer defining a downwardly facing internal shoulder;

a tubular locking mechanism secured to the bottom of said tubing string;

said locking mechanism comprising an inner mandrel element secured to said bottom end of the tubing string, and a locking sleeve freely surrounding said inner mandrel element and carrying a plurality of peripherally spaced, radially shiftable locking means;

supporting means on said inner mandrel element engagable and disengagable with said locking means by axial movements of said inner mandrel relative to said locking sleeve to permit radial shifting and retraction of said locking means into and out of engagement with said downwardly facing internal shoulder; and J-pin and slot means interconnecting said inner mandrel and said locking sleeve, said J-pin and slot means permitting rotational movements of said locking sleeve relative to said mandrel but permitting only limited axial movements of said packing sleeve relative to said mandrel whereby a first cycle of successive downward and upward movements of the tubing string effects the rigid locking of said locking means with said downwardly facing, internal shoulder and a second cycle of downward and upward movements of the tubing string effects the release of said locking means from said internal shoulder.

2. The apparatus of claim 1 wherein said peripherally spaced, radially shiftably locking means comprises a plurality of collet arms formed on said tubular locking sleeve, each collet arm having a radially thickened locking portion engagable by axial movement of said locking sleeve with said internal shoulder.

3. The apparatus of claim 2 wherein said supporting means on said inner mandrel comprises an annular external surface engagable with said locking means by axial upward movement of said inner mandrel to hold said radially thickened locking portions radially outward to lockingly engage said internal holder.

4. The apparatus of claim 3 further comprising a recessed surface portion on said collet arms adjacent to said annular external surface to permit release of said radially thickened locking portions from said inner shoulder by downward movement of said inner mandrel relative to said locking sleeve.

5. The apparatus of claim 1 wherein said locking sleeve and said J-slot means are not secured against rotation relative to said inner mandrel element during insertion of said tubular locking mechanism into the subterranean well bore, thereby permitting unlimited rotation of the tubing string to assist in the insertion of the locking mechanism into said subterranean well bore, whereby the position of the locking sleeve relative to the inner mandrel is unknown when said locking sleeve approaches the packer.

6. The apparatus of claim 1 wherein said J-pin and slot means comprises a C-ring defining a J-slot pattern in its peripheral surface; said mandrel having an annular external recess on its periphery receiving said C-ring; and said J-pin comprises an internally projecting, radial pin secured to said locking sleeve.

7. The apparatus of claim 1 wherein said internal shoulder defining means in said hollow bore packer comprises a sleeve rigidly secured to said hollow bore packer and defining said downwardly facing internal shoulder.

8. The apparatus of claim 1 wherein said downwardly facing locking shoulder means comprises internal left hand threads provided on the upper portion of said packer.

9. The apparatus of claim 8 wherein said peripherally spaced, radially shiftable locking means comprises a plurality of peripherally spaced collet arms formed on said locking sleeve and having head portions carrying external thread portions engagable with said internal left hand threads.

10. The apparatus of claim 8 wherein said supporting means on said inner mandrel comprises an annular external surface engagable with said collet head portions by axial upward movement of said inner mandrel to retain said radially thickened locking portions radially outward in locking engagement with said internal left hand threads.

11. The apparatus of claim 9 further comprising a recessed surface portion on said inner mandrel adjacent to said annular external surface to permit release of said radially thickened locking portions from said internal left hand threads by downward movement of said inner mandrel relative to said locking sleeve.

12. The apparatus of claim 8 wherein said locking sleeve and said J-slot means are not secured against rotation relative to said inner mandrel element during insertion of said tubular locking mechanism into the subterranean well bore, thereby permitting unlimited rotation of the tubing string to assist in the insertion of the locking mechanism into said subterranean well bore, whereby the position of the locking sleeve relative to the inner mandrel is unknown when said locking sleeve approaches the packer.

13. The apparatus of claim 8 wherein said J-pin and slot means comprises a C-ring defining a J-slot pattern in its peripheral surface; said mandrel having an annular external recess on its periphery receiving said C-ring; and said J-pin comprises an internally projecting, radial pin secured to said locking sleeve.

14. The apparatus of claim 1 further comprising a tubular tool string located above said locking mechanism but secured to said tubing string by said mandrel; said tool string including a tubular safety joint serially connected in said tool string above said locking mechanism; said safety joint comprising a first sub having a first end connectable in said tool string and a second end defining a locking collet; a second sub connectable in said tool string and telescopingly engaged with said second end of said first sub; said second sub defining a downwardly facing internal shoulder abuttingly engaged by said locking collet; a retention sleeve axially shiftably mounted in one of said subs between a first position securing said locking collet in engagement with said internal shoulder and a second position releasing said collet from said internal shoulder; and shearable means for securing said retention sleeve in said first position.

15. The apparatus defined in claim 14 wherein said retention sleeve further comprises engagable means for shifting said sleeve from said first to said second position.

16. The apparatus of claim 8 further comprising a tubular tool string located above said locking mechanism but secured to said tubing string; said tool string including a safety joint serially connected in said tool string above said locking mechanism; said safety joint comprising a first sub having a first end connectable in said tool string and a second end defining a locking collet; a second sub connectable in said tool string and telescopingly engaged with said second end of said first sub; said second sub defining a downwardly facing internal shoulder abuttingly engaged by said locking collet; a retention sleeve axially shiftably mounted in one of said subs between a first position securing said locking collet in engagement with said internal shoulder and a second position releasing said collet from said internal shoulder; and shearable means for securing said retention sleeve in said first position.

17. The apparatus defined in claim 16 wherein said retention sleeve further comprises engagable means for shifting said sleeve from said first to said second position.

18. The method of releasably, lockingly engaging the end of a tubing string in a hollow bore packer set in a subterranean well comprising the steps of:

providing a downwardly facing internal shoulder in said hollow bore packer;

securing a locking tool to the end of a tubing string and inserting the locking tool through the well bore to a locking position adjacent and below said downwardly facing shoulder only by downward movement of said tubing string followed by upward movement of said tubing string; and releasing said locking tool from said locking position relative to said downwardly facing locking shoulder only by downward movement of said tubing string to a releasing position and retaining said locking tool in said releasing position during subsequent upward movement of said tubing string.

19. The method of releasably, lockingly engaging the end of a tubing string in a hollow bore packer set in a subterranean well comprising the steps of:

providing a downwardly facing internal shoulder in said hollow bore packer;

securing a locking tool to the end of a tubing string and inserting the locking tool through the well bore to a locking position adjacent and below said downwardly facing shoulder only by downward movement of said tubing string followed by upward movement of said tubing string;

releasing said locking tool from said locking position relative to said downwardly facing shoulder only by downward movement of said tubing string to a releasing position and retaining said locking tool in said releasing position during subsequent upward movement of said tubing string; and manipulating said tubing string upwardly and downwardly through a plurality of cycles, including an upward pull on the order of 100 thousand pounds when the locking elements are presumably engaged with said downwardly facing shoulder, thereby eliminating false indications of locking engagement between the tubing string and the set packer.

20. The method of releasably, lockingly engaging the end of a tubing string in a hollow bore packer set in a subterranean well comprising the steps of:

providing internal threads on the upper portion of said packer;

securing a locking tool to the end of a tubing string and inserting the locking tool through the well bore to a locking position adjacent said internal threads only by downward movement of said tubing string followed by upward movement of said tubing string;

releasing said locking tool from said locking position relative to said internal threads only by downward movement of said tubing string to a releasing position and retaining said locking tool in said releasing position during subsequent upward movement of said tubing string; and manipulating said tubing string upwardly and downwardly through a plurality of cycles, including an upward pull on the order of 100 thousand pounds when the locking elements are presumably engaged with said internal square threads, thereby eliminating false indications of locking engagement between the tubing string and the set packer.

21. The method of releasably, lockingly engaging the end of a tubing string in a hollow bore packer set in a subterranean well, comprising the steps of:

providing internal threads on the upper portion of said packer;

securing a locking tool to the end of a tubing string and inserting the locking tool through the well bore to a locking position adjacent said internal threads only by downward movement of said tubing string followed by upward movement of said tubing string; and releasing said locking tool from said locking position relative to said internal threads by downward movement of said tubing string to a releasing position and retaining said locking tool in said releasing position during subsequent upward movement of said tubing string.

22. The method of releasably, lockingly engaging the end of a tubing string relative to a hollow bore packer set in a subterranean well, comprising the steps of:

providing threads in association with said packer;

securing a locking tool to the end of a tubing string and inserting the locking tool through the well bore to a locking position adjacent said threads only by downward movement of said tubing string followed by upward movement of said tubing string; and releasing said locking tool from said locking position relative to said threads only by downward movement of said tubing string to a releasing position and retaining said locking tool in said releasing position during subsequent upward movement of said tubing string.

* * * * *